US005415916A

United States Patent [19]

Giese

[11] Patent Number: 5,415,916

[45] Date of Patent: May 16, 1995

[54] RUFFLING TAPE AND METHOD OF RUFFLING

[76] Inventor: Mary Giese, 1814 Marian Ave., Thousand Oaks, Calif. 91360

[21] Appl. No.: 863,571

[22] Filed: Apr. 6, 1992

[51] Int. Cl.[6] ..... A47H 5/00; A47H 13/14

[52] U.S. Cl. ..... 428/102; 160/132; 160/135; 160/340; 160/341; 160/344; 160/347; 160/348; 428/115; 428/220; 428/346; 428/347; 428/349; 428/390; 428/391

[58] Field of Search ..... 428/102, 115, 390, 391, 428/508, 515, 516, 518, 220, 500, 346, 354, 347, 349; 160/344, 348, 340, 341, 347; 112/409, 427, 132, 135

[56] References Cited

U.S. PATENT DOCUMENTS

| | | | |
|---|---|---|---|
| 820,786 | 5/1906 | Henson | 160/340 |
| 1,062,293 | 5/1913 | McNeil | 112/427 |
| 1,913,825 | 6/1933 | Baker | 428/102 |
| 4,007,835 | 2/1977 | Klothe | 428/102 |
| 4,390,055 | 6/1983 | Fenley | 160/348 |
| 4,655,272 | 4/1987 | Reilly | 160/344 |
| 4,765,388 | 8/1988 | Dohlemann | 160/348 |
| 4,902,739 | 2/1990 | Ona | 428/391 |

FOREIGN PATENT DOCUMENTS

| | | | |
|---|---|---|---|
| 2345119 | 10/1977 | France | 160/344 |

*Primary Examiner*—Nasser Ahmad

*Attorney, Agent, or Firm*—Richard D. Slehofer

[57] ABSTRACT

The improved ruffling tape includes a heat fusible, flexible, resilient, elongated strip of thermoplastic or the like, to one side of which is a pull string loosely secured thereto, as by spaced stitches along the length of the strip, which stitches run over the string and into the strip. The strip can include the heat fusible material, if desired, only on the side opposite that bearing the string. The string has one end thereof anchored thereto, as by a knot which does not pass through the stitches. The The string may have a slip covering of silicone or the like. In accordance with the method, the strip is heat fused to one side of a fabric, with the string and stitches exposed. The fabric is then ruffled by pulling the free end of the string, with or without simultaneously pushing said fabric toward the tied end of the string. When the desired ruffling is obtained, the free end of the string is tied off against the adjacent end of the tape to hold the ruffling in place.

6 Claims, 1 Drawing Sheet

RUFFLING TAPE AND METHOD OF RUFFLING

BACKGROUND OF THE INVENTION

1. Field of the Invention

This invention applies to clothing construction, home sewing, home decorating and craft projects. Specifically, the invention uses manufactured strips of fusible, nonwoven materials into which pulling threads or cords are added. The tape could then be fused to a material by ironing. The threads or cords are then pulled to the desired fullness to meet the needs of the finished product. Pulling the cords, here, refers to the technique of holding the threads or cords on one side while pushing the material to the other side causing ruffles, gathers, pleats or easing to form on the material. The purpose of this invention is to simplify the process of gathering, ruffling, pleating or easing of materials used for sewing, decorating or craft designs.

2. Prior Art

In sewing, decorating and craft designs, there is frequently a need to gather a longer length of material into a shorter length. The shorter length of material, then, has extra fabric fullness which is an integral part of the design, either because of the decorative effect, such as a design with ruffles, or because this gathering process is needed in fabrication even if it is not an obvious part of the finished look.

At this time there are a number of methods used to prepare materials for gathering. One method is to machine baste (on a sewing machine) two rows of stitching about ½ inch apart. Another method is to use a cord and a zig-zag stitch on the sewing machine to stitch over the cord. Both of these method are time consuming and tedious. There are also ruffling attachments for sewing machines.

More recently a tape has been devised which can form ruffles in a fabric after the tape is sewn to the back of the fabric. However, whenever sewing or stitching is carried out, particularly on pleated materials, much tedious time-consuming work is involved.

Accordingly, it would be desirable to be able to provide an improved means and method of pleating and ruffling fabrics which would eliminate stitching and sewing steps, and therefore reduce fabrication time. Such means and method should be simple, rapid, effective and inexpensive and be adaptable to a wide variety of fabrics, including drapery materials, laces, clothing materials, etc.

SUMMARY OF THE INVENTION

The improved ruffling tape and the improved ruffling method of the present invention satisfy all the foregoing needs. The tape and method are substantially as set forth in the Abstract of the Disclosure.

Thus, the tape is flexible and resilient and comprises an elongated strip of heat fusible fabric or fabric-like material, such as a thermoplastic, e.g., polyethylene, polyvinyl, etc., to one side of which is loosely secured at least one pull string. The string extends beyond opposite ends of the strip and means are provided, such as a knot, to anchor one end of the string to one end of the tape. A plurality of stitches spaced along the length of the strip pass loosely, in each instance, over the string and are embedded in the strip so that the string can pull through the stitches. Preferably, the string is coated with a slippery material such as silicone plastic to facilitate its sliding through the stitches.

In accordance with a preferred embodiment of the method, the strip is heat fused to the reverse side of a flexible resilient fabric or the like, with the string and stitches of the strip exposed. The free end of the string is then pulled, with or without simultaneously shoving the fabric toward the anchored end of the string, thus effecting the desired ruffling or pleating. The free end of the string is then anchored to the adjacent end of the strip, as by knotting it so that it can't slip through the stitches, thus making the pleats permanent.

No sewing or stitching is needed either to form the pleats or to anchor the tape in place on the fabric. Therefore, the method is simple, rapid, inexpensive and adapted to a wide variety of fabric materials. It will be understood that by fabric is meant material of extended surface area and sufficiently flexible and thin to be easily pleated or ruffled.

Various other features of the improved ruffling tape and method of the present invention are set forth in the following detailed description and accompanying drawings.

DETAILED DESCRIPTION

FIGS. 1–4.

Now referring more particularly to FIGS. 1–4 of the drawings, a preferred embodiment of the invention is schematically depicted therein. Thus, ruffling tape 10 is shown, which comprises an elongated, preferably rectangular strip 12 of thin, flexible, resilient fabric-like material, such as a thermoplastic, e.g., polyvinyl chloride or polyethylene, polypropylene or an extruded heat-fusible cellulosic such as rayon. Alternatively, strip 12 can be cloth with the thermoplastic fused to one side thereof. The tape material should be capable of being fused to a fabric at a low temperature such as that generated by a conventional domestic fabric-smoothing iron or the like.

Figure 1:
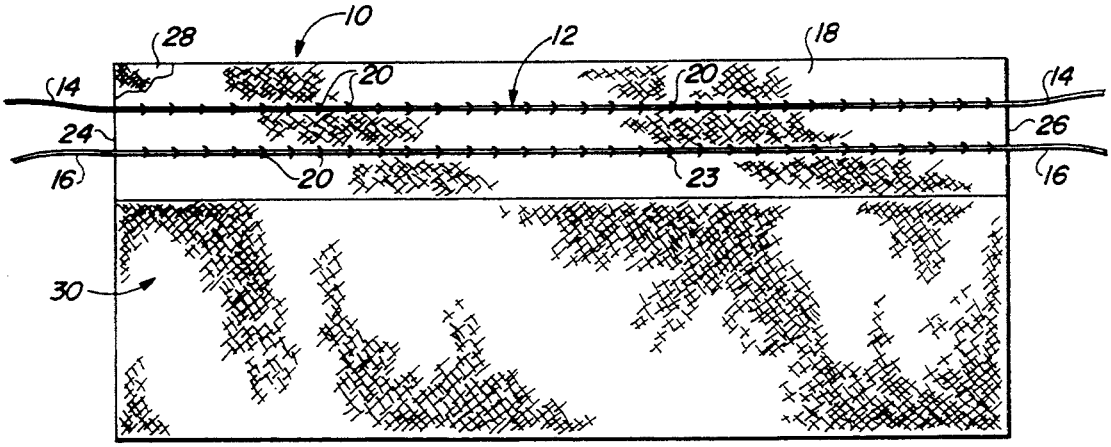
FIG. 1 is a schematic side elevation, partly broken away, of a preferred embodiment of the improved ruffling tape of the present invention, shown heat fused to a drapery fabric, but with the strings thereof untied.

Tape 10 also includes one or more elongated pull strings 14 and 16 loosely secured to strip 12 at one side 18 thereof, along the length of strip 12, as by stitches 20 spaced along the length of strip 12, loosely lapping over strings 14 and 16 and passing into the body of strip 12. The two lines of stitches 20 can each comprise a single thread 22 and a separate single thread 23 spiraled through strip 12 and out side 18 thereof, as shown in FIG. 1. Strings 14 and 16 extend beyond opposite ends 24 and 26 of strip 12.

In FIG. 1, strip 12 is shown heat fused to the upper end 28 of an elongated strip 30 of lace or the like. Tape 10 in FIG. 1 is in its unfinished state and lace strip 30 has not been ruffled as yet by tape 10.

Figure 2:
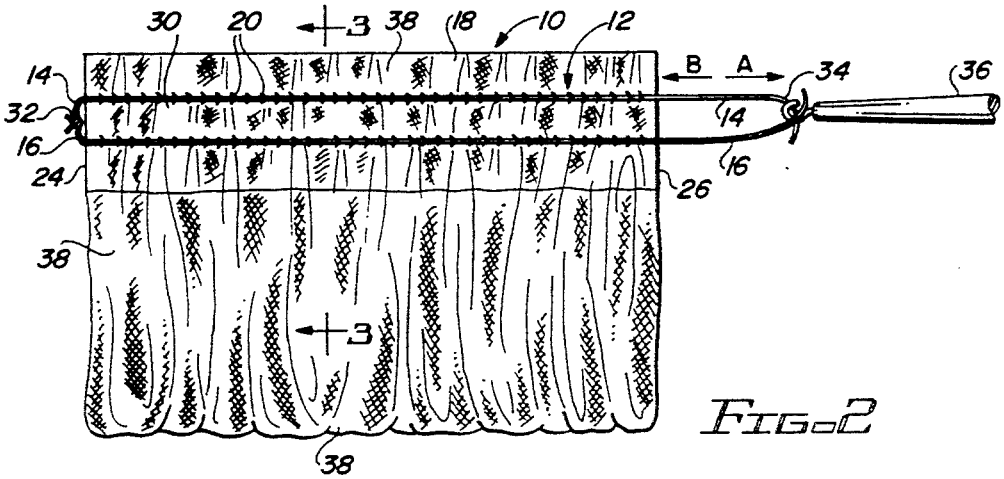
FIG. 2 is a schematic side elevation of the ruffling tape of FIG. 1 with one end of the strings thereof tied and the opposite end thereof being pulled by a tool to ruffle the drapery fabric attached to the tape.
Figure 3:
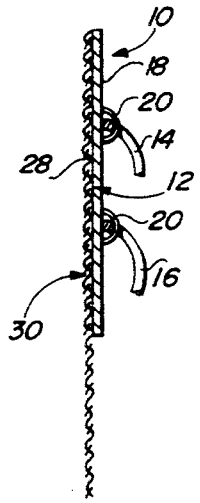
FIG. 3 is an enlarged schematic fragmentary transverse cross-section of the ruffling tape of FIG. 1, taken along the section line 3—3 of FIG. 2; and, FIG. 4 is an enlarged transverse cross-section of a string of the ruffling tape of FIG. 1, showing the silicone plastic slip covering thereon.

In accordance with the present method, in order to be able to carry out the ruffling, strings 14 and 16 at end 24 are first tied together to form a knot 32 which closely abutts end 24, as shown in FIG. 2. The opposite ends of strings 14 and 16 at end 26 are then pulled away from strip 12 in the direction of arrow A (FIG. 2) while holding lace strip 30 at end 26 stationary or pushing strip 30 toward end 24 in the direciton of arrow B (FIG. 2). To facilitate pulling strings 14 and 16, they may be tied to form a loop 34 (FIG. 2) and loop 34 can be easily pulled by a tool such as a button hook 36. This results in ruffling tape 10 and attached lace strip 30 into a plurality of spaced folds or pleats 38 to provide the desired decorative effect.

After the above step, the present method is completed by knotting loop 36 close to end 26 to prevent tape 10 and lace strip 30 from unruffling. The construction is now permanent.

Figure 4:
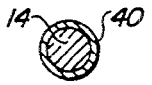

In order to facilitate the pulling of strings 14 and 16 through stitches 20, strings 14 and 16 can be coated with a thin layer 40 of a solid slip agent, such as a silicone plastic or the like (FIG. 4). Tape 10 is inexpensive, durable, can be manufactured in a variety of lengths, widths of thicknesses utilizing various conventional materials. Tape 10 eliminates the need to sew on or stitch on a backing tape to lace a drapery, is simple and easy to use, is inexpensive and saves valuable time and effort. Its use, as per the present method, results in perfect permanent ruffles and pleats.

The following specific Example illustrates the use of the tape of the invention or the method of the invention.

EXAMPLE

A ruffling tape for lace is formed from heat fusible nonwoven about 0.25 mm thick polyethylene tape which is ¾" wide and 24" long. The tape utilizes two silicone-coated nylon pull strings spaced ¼" apart and each ¼" from each edge of the tape. The pull strings run the length of the tape. The strings are loosely held against one side of the tape by diagonal stitching, so that the strings can be easily pulled through the stitching.

In accordance with the method, one end of the string is tied with a knot abutting an end of the tape. The side of the tape not bearing the string is then heat sealed, as by a domestic iron, to the top end of the back of a strip of lace. The opposite end of the thread is then formed into a loose loop, which is then pulled away from the tape and lace to ruffle both into desired pleats, after which the loop is knotted close to the adjacent end of the tape to hold the ruffles in place.

A parallel test using ruffle tape comprising a pair of cotton pull threads, a cotton ruffle strip with polyethylene coated on the side opposite that bearing the threads produced comparable results.

It can be appreciated that the basic invention involves the basic combination of a heat fusible ruffling tape having a pull string loosely secured thereto. The pull string can be held in place on one side of the strip by stitches, as hereinabove described. Alternatively, the pull string itself can be loosely sewn to the strip for subsequent compression of the strip along the string to obtain ruffling.

Accordingly, an improved ruffle tape and method of using the same are provided. Various modifications, changes, alterations and additions can be made in the tape, its components and parameters and in the method, its steps and parameters. All such modifications, changes, alterations and additions as are within the scope of the appended claims form part of the present invention.

What is claimed is:

1. A ruffling tape for fabrics comprising, in combination:

a) an elongated, flat, flexible, resilient non woven cloth strip having opposite ends and opposite one and reverse surfaces and having heat fusible, flexible, resilient material on said one surface;

b) at least one pull string having opposite ends and disposed along the length of said reverse surface of said strip, said one pull string is coated with silicone slip agent;

c) a plurality of spaced stitches disposed along the length of said strip and bridging and loosely attaching said string to said reverse side of said strip; and d) means releasably anchoring one end of said string at one of said opposite ends of said strip, such that said strip can be moved towards said anchored end of said strip while pulling on said free opposite end of said string.

2. The sewing notion as recited in claim 1 wherein: said thread is stitched along the length of said tape and formed by an in-and-out movement of a sewing needle.

3. The ruffling tape of claim 2 wherein said strip comprises heat activated adhesive material on at least one side thereof, whereby said strip can be fused to fabric by ironing.

4. The ruffling tape of claim 3 wherein said strip may be selected from the group consisting of a) polyvinyl chloride, b) polyethylene, c) polypropylene, and d) cellulosic thermoplastic material.

5. The ruffling tape of claim 1 wherein said tape includes at least two of said strings in spaced parallel relation along the length, and wherein each of said strings is secured to said strip by said spaced stitches along said strip length.

6. The ruffling tape of claim 5 wherein said anchoring means comprises a knot releasably joining said strings at said one end.

* * * * *